US006873096B2

(12) United States Patent
Bucher

(10) Patent No.: US 6,873,096 B2
(45) Date of Patent: Mar. 29, 2005

(54) MASK SUPPORT BLADE STRUCTURE HAVING AN INSERT

(75) Inventor: Alan Weir Bucher, Manheim, PA (US)

(73) Assignee: Thomson Licensing S.A., Boulogne-Billancourt (FR)

( * ) Notice: Subject to any disclaimer, the term of this patent is extended or adjusted under 35 U.S.C. 154(b) by 141 days.

(21) Appl. No.: 09/880,214

(22) Filed: Jun. 13, 2001

(65) Prior Publication Data

US 2002/0190628 A1 Dec. 19, 2002

(51) Int. Cl.[7] ..... H01J 29/07; H01J 29/81

(52) U.S. Cl. ..... 313/407; 313/402; 313/404; 313/408

(58) Field of Search ..... 313/407, 404, 313/408, 402, 403, 405, 406, 269

(56) References Cited

U.S. PATENT DOCUMENTS

| | | | | |
|---|---|---|---|---|
| 5,030,154 A | * | 7/1991 | Palac | 445/30 |
| 5,416,377 A | * | 5/1995 | Kim | 313/402 |
| 5,686,784 A | * | 11/1997 | Thoms et al. | 313/407 |
| 6,246,164 B1 | | 6/2001 | Heyman et al. | 313/407 |
| 6,509,679 B1 | * | 1/2003 | Ligthart et al. | 313/407 |

FOREIGN PATENT DOCUMENTS

| | | | |
|---|---|---|---|
| JP | 57096448 | 6/1982 | H01J/29/80 |
| JP | 2000285820 | 10/2000 | H01J/29/07 |
| WO | 00/33348 | 6/2000 | H01J/29/07 |
| WO | 01/48784 | 7/2001 | H01J/29/07 |
| WO | 02/059929 | 8/2002 | H01J/29/00 |

* cited by examiner

*Primary Examiner*—Nimeshkumar D. Patel
*Assistant Examiner*—Mariceli Santiago
(74) *Attorney, Agent, or Firm*—Joseph S. Tripoli; Harvey D. Fried; Richard LaPeruta, Jr.

(57) ABSTRACT

The present invention provides an improved support blade structure for use on a tension mask frame assembly. The support blade structure is formed of a material having a first coefficient of thermal expansion and includes fastening portions and an insert member connected at a generally central location to the support blade structure. The insert member is formed of a material having a second coefficient of thermal expansion and has a plurality of apertures extending in a row along its length. The aperatures are dimensioned to be larger than the fastening portions passing therethrough to loosely connect the insert member to the support blade structure. This allows the insert member to be connected at the center while it's end are free to slide relative to the support blade structure during thermal cycling.

10 Claims, 5 Drawing Sheets

MASK SUPPORT BLADE STRUCTURE HAVING AN INSERT

FIELD OF THE INVENTION

This invention relates to color picture tubes having tension masks, and more particularly to a tension mask frame assembly having a mask support blade structure with an insert for supporting the tension mask.

BACKGROUND OF THE INVENTION

A color picture tube includes an electron gun for generating and directing three electron beams to the screen of the tube. The screen is located on the inner surface of a faceplate of the tube and is made up of an array of elements of three different color emitting phosphors. A color selection electrode, which may be either a shadow mask or a focus mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

One type of color picture tube has a tension mask affixed to two parallel support frame members under tension and mounted within a faceplate panel thereof. In order to maintain the tension on the mask, the mask must be attached to a relatively massive frame. Although such tubes have found wide consumer acceptance, there is still a need for further improvement, to reduce the weight and cost of the mask-frame assemblies in such tubes while maintaining the necessary tension on the mask.

It has been suggested that a lighter frame could be used in a tension mask tube if the required tension on a mask is reduced. One way to reduce the required mask tension is to make the mask from a material having a low coefficient of thermal expansion. However, a mask from such material would require a frame of a material having a similar coefficient of thermal expansion, to prevent any mismatch of expansions during thermal processing that is required for tube manufacturing, and during tube operation. Because the metal materials that have low coefficients of thermal expansion are relatively expensive, it is relatively costly to make both the mask and frame out of identical or similar low expansion materials. Therefore, it is desirable to use the combination of a low coefficient of thermal expansion tension mask with a higher coefficient of thermal expansion frame, and to provide a solution to the problem that exists when there is a substantial mismatch in coefficients of thermal expansion between a tension mask and its frame.

SUMMARY OF THE INVENTION

The present invention provides an improved mask support blade structure for use on a tension mask frame assembly. The support blade structure is formed of a material having a first coefficient of thermal expansion and includes fastening portions and an insert member. The insert member is formed of a material having a second coefficient of thermal expansion and includes a plurality of apertures extending in a row along its length. The insert member is connected to the support blade structure with at least one fastening portion at a generally central location along the length of the insert member. The remaining fastening portions connect the insert portion to the support blade structure through the apertures which are dimensioned to be larger than the fastening portions such that the fastening portions loosely fit into the apertures of the insert member. This allows the insert member to be fixed at the center while its' ends are free to slide relative to the support blade structure during thermal cycling.

BRIEF DESCRIPTION OF THE DRAWINGS

The invention will now be described by way of example with reference to the accompanying figures of which.

DETAILED DESCRIPTION OF THE INVENTION

Figure 1:
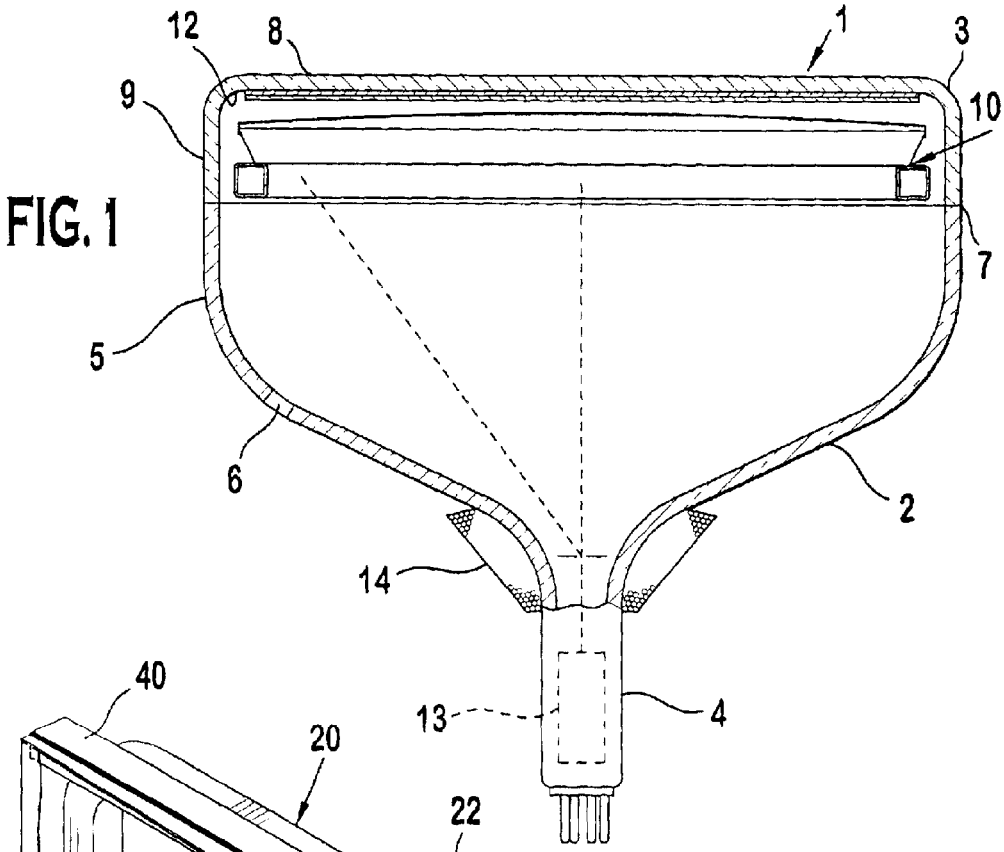
FIG. 1 is a cross sectional view of a color picture tube having a tension mask frame assembly mounted behind the face plate panel.

FIG. 1 shows a color picture tube 1 having a glass envelope 2 comprising a rectangular faceplate panel 3 and a tubular neck 4 connected by a funnel 5. The funnel 5 has an internal conductive coating (not shown) that extends from an anode button 6 toward the panel 3 and to the neck 4. The panel 3 comprises a viewing faceplate 8 and a peripheral flange or sidewall 9, which is sealed to the funnel 5 by a glass frit 7. A three-color phosphor screen 12 is carried by the inner surface of the panel 3. The screen 12 is a line screen with the phosphor lines arranged in triads, each of the triads including a phosphor line of each of the three colors. A color selection tension mask frame assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the tension mask frame assembly 10 to the screen 12.

The tube 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

Figure 2:
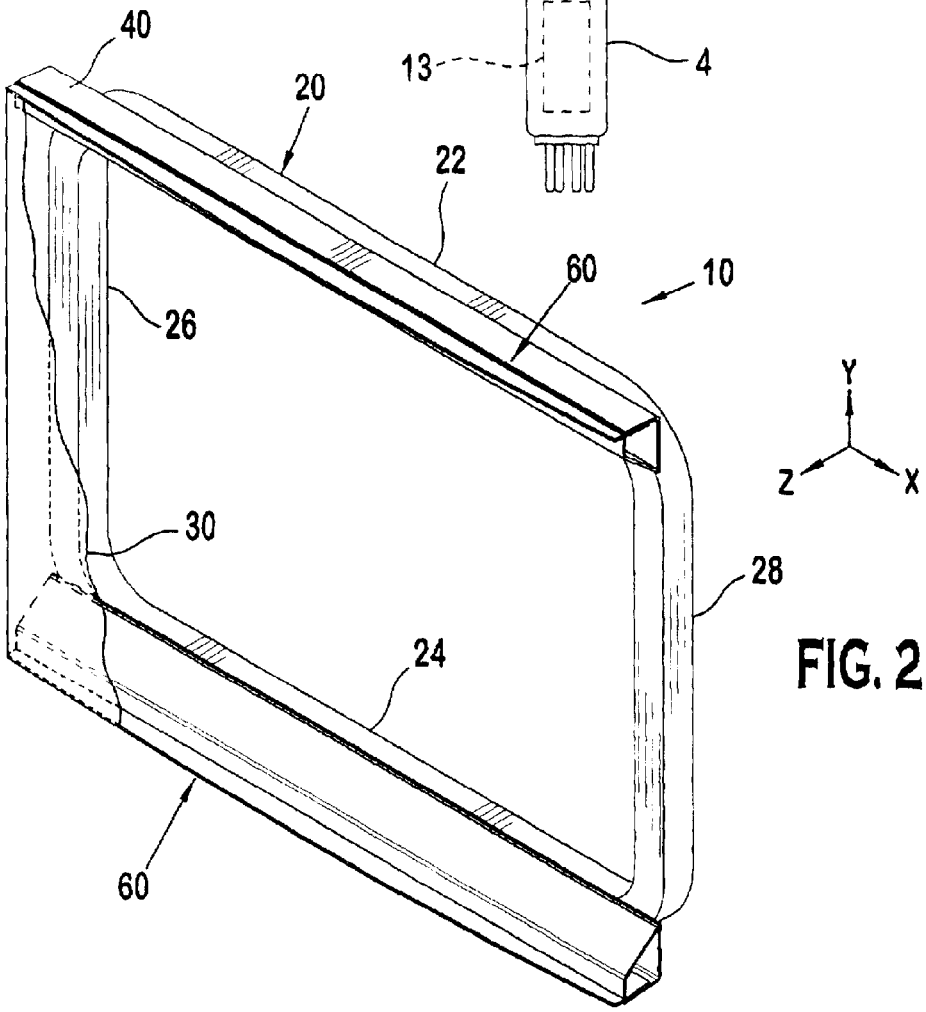
FIG. 2 is a perspective view of the tension mask frame assembly shown in FIG. 1.

The tension mask frame assembly 10, as shown in FIG. 2, includes a frame 20 comprising two long sides 22 and 24, and two short sides 26 and 28. The two long sides 22, 24 of the frame are parallel to a central major axis, X, of the tube; and the two short sides 26, 28 parallel a central minor axis, Y, of the tube. Although the tension mask frame assembly 10 is shown here diagramatically as a sheet for simplicity, it includes an apertured mask 30 that contains a plurality of metal strips (not shown) having a multiplicity of elongated slits (not shown) therebetween that parallel the minor axis of the mask 30. A support blade structure 40 is fastened to the frame 20 and may vary in height from the center of each section longitudinally to the ends of the sections to permit the best curvature and tension compliance over the mask 30.

Figure 3:
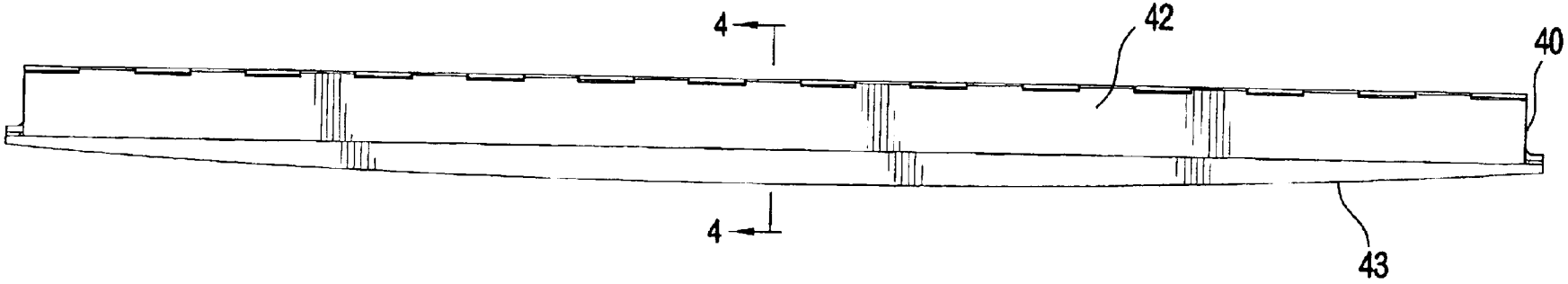
FIG. 3 is a front view of a support blade structure.
Figure 4:
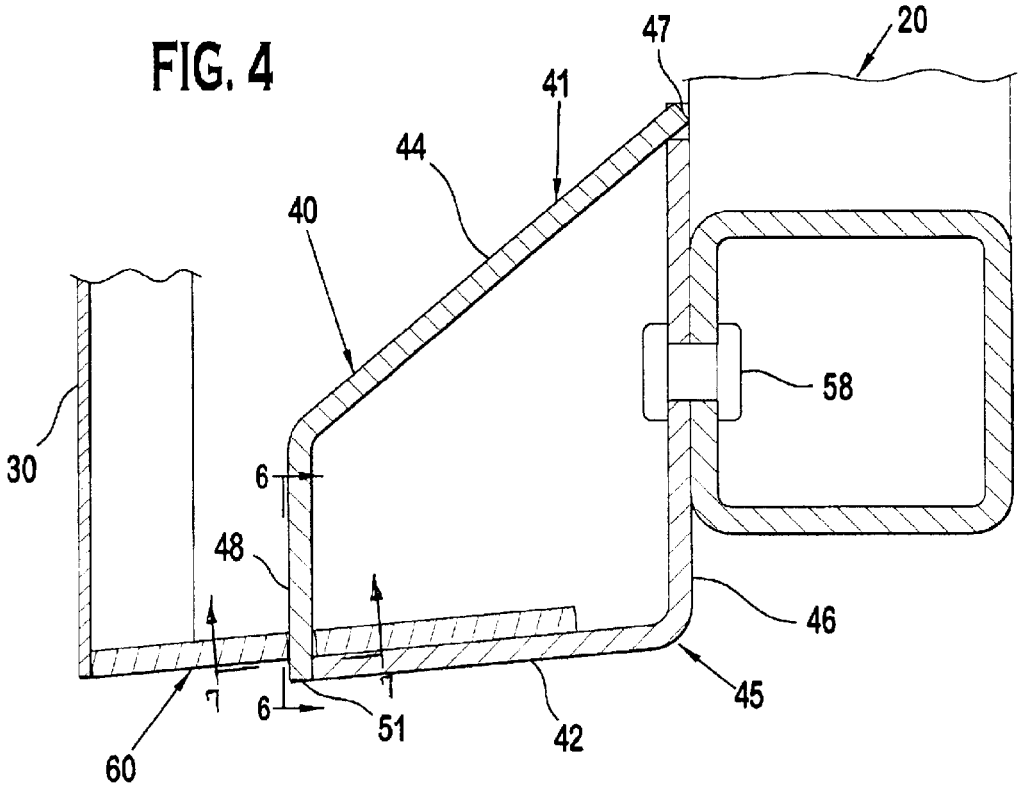
FIG. 4 is cross sectional view taken along the line 4—4 of FIG. 3.
Figure 5:
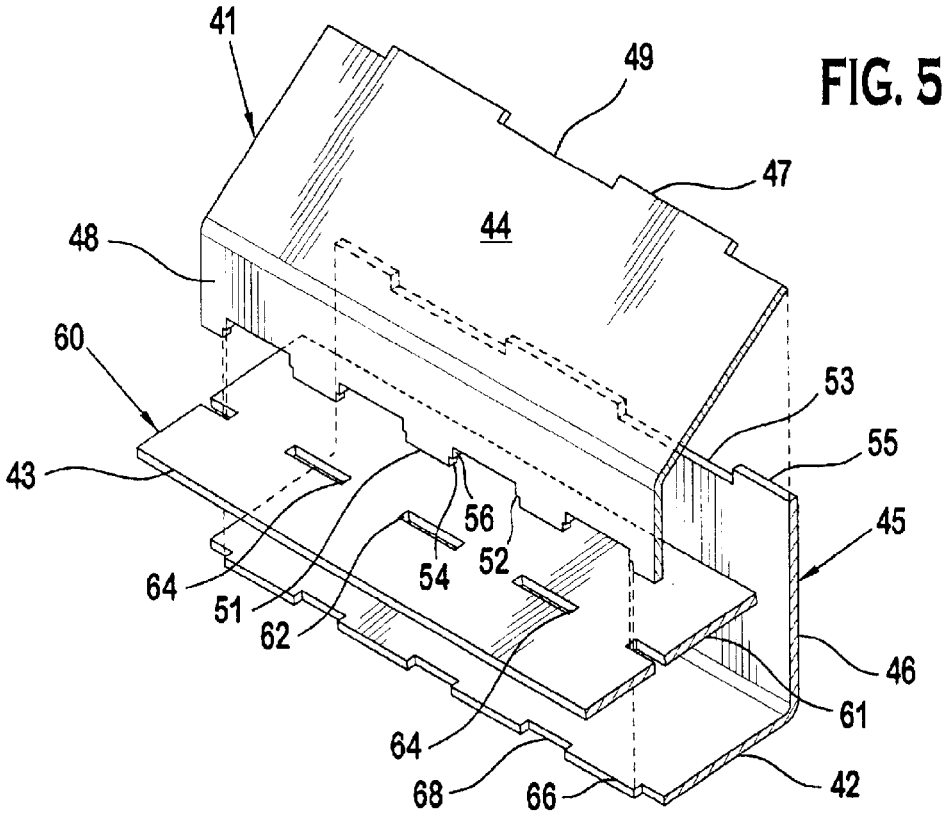
FIG. 5 is a perspective view of the support blade structure during assembly.

Referring to FIG. 3, the support blade structure 40 has a mask receiving edge 43 located on insert member 60 which extends from a front side wall 48. The mask receiving edge 43 may be appropriately contoured so that the applied mask conforms with the inner surface of the panel 3. Further detail of the support blade structure 40 can be seen in FIGS. 4 and 5. A first half 41 is joined to a second half 45 to form a closed tubular structure which contains the insert member 60. The first half 41 forms a bottom wall 44 and a front side wall 48 of the tubular structure. The second half 45 forms a rear side wall 46 and a top wall 42 of the tubular structure. As best shown in FIG. 5, a series of projections 47 and recesses 49 extend along an edge of the bottom wall 44. A plurality of fastening portions, or insert-securing tabs 51, extend from an edge of the front side wall 48. Each insert-securing tab 51 has a stop surface 52 which separates a narrow portion 54 from a wide portion 56.

Turning now to the second half 45, the rear side wall 46 has a plurality of projections 55 separated by recesses 53 extending along an edge. Similarly, the top wall 42 has a plurality of projections 66 separated by recesses 68.

Referring to FIGS. 4–8, the insert member 60 is formed from a plate having a thickness which is greater than the thickness of the tension mask 30 and is profiled to have a mask receiving edge 43 and a back surface 61. A central tab receiving opening 62 is preferably formed around a centerline C which is centrally located along the length of the insert member 60. It should be understood by those reasonably skilled in the art that although it is preferred to have a single central tab-receiving opening around the centerline C, this central tab receiving opening may alternately consist of a plurality of central tab receiving openings located in the vicinity of the center line C. A plurality of outer tab receiving openings 64 each being dimensioned to be larger than the central tab-receiving opening 62 extends in a row outward from the central tab receiving opening 62. The support blade member 40 is assembled as best shown in FIG. 5 by first urging the insert-securing tabs 51 though the central and outer tab receiving openings 62, 64 of the insert member 60. The first half 41 along with the insert member 60 are then fastened to the second half 45 such that the projections 47 fit into recesses 53 and projections 55 fit into recesses 49. Similarly, the narrow portions 54 of the insert-securing tabs 51 fit into recesses 68. Each of the respective projections 47, 55, 66, and insert-securing tabs 51 may then be preferably fastened to each other as for example, by welding. The first and second halves 41, 45 may alternatively be secured to each other by an interference fit between the projections 47, 55, 66 and the recesses 49, 53, 68 or by selectively welding portions of each half. Alternatively, the first and second halves 41,45 maybe constructed of one piece so as to be folded and secured along each edge with insert-securing tabs 51 and recesses 68.

The support blade structure 40 is then fixed to the frame 20 along the rear side wall 46. Once the tension mask 30 is applied to the mask receiving edge 43, a force cantilever is applied to the insert member 60 causing it to rotate about a point where it contacts the front side wall 48 of the first half 41. The back surface 61 is therefore urged against an inner surface of the top wall 42 causing the insert member 60 and the tension mask 30 to remain correctly positioned.

Figure 6:
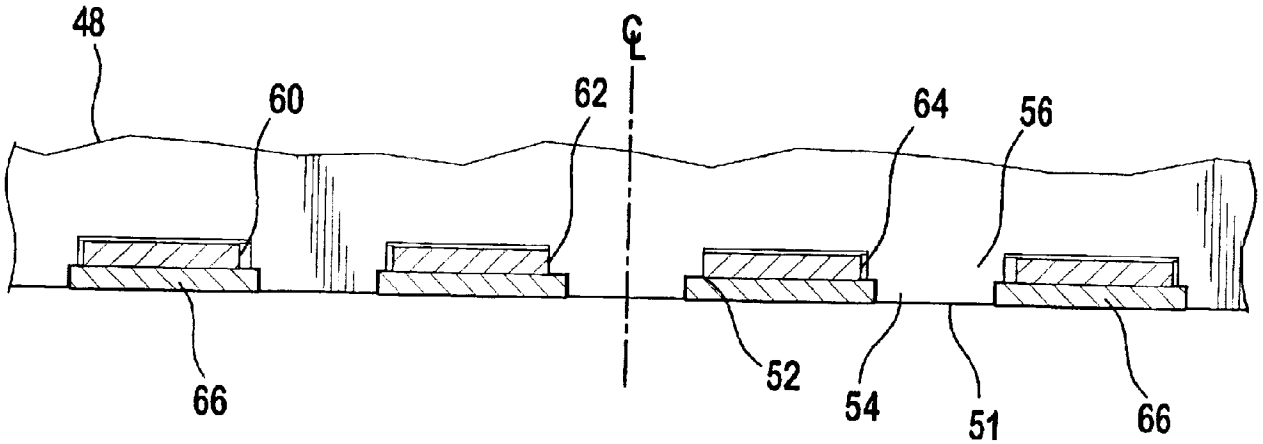
FIG. 6 is a partial cross sectional view of the support blade structure taken along line 6—6 of FIG. 4 showing the insert apertures and support blade structure portions passing therethrough.
Figure 7:
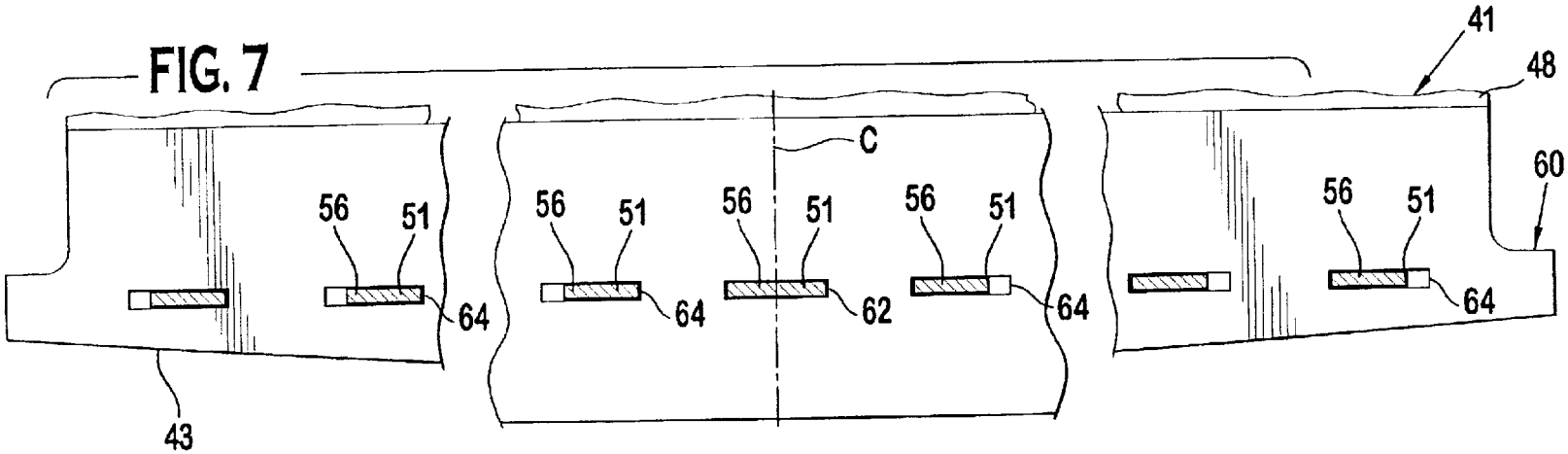
FIG. 7 is a partial cross sectional views taken along the line 7—7 of FIG. 4 showing the relative position between the insert and support blade structure before thermal cycling.

Turning now to FIG. 6, the insert-securing tabs 51 are inserted into the recesses 68 of the top wall 42 until the stop surfaces 52 abut the projections 66. As best shown in FIGS. 6 and 7, the central tab receiving opening 62 is dimensioned to form a tight fit with the wide portion 56 of the insert-securing tab 51 inserted therein. The outer tab receiving openings 64 are dimensioned to loosely receive the wide portions 56 of the insert-securing tabs 51 inserted therein. It should be understood that either the tab receiving openings 62, 64 or the wide portions 56 may be dimensionally altered to create this tight fit or loose fit as required. It should also be understood that either one or several tabs 51 around the center may be dimensioned to have a tight fit with the respective openings 62, 64 to connect the insert member 60 to the support blade structure 40.

Figure 8:
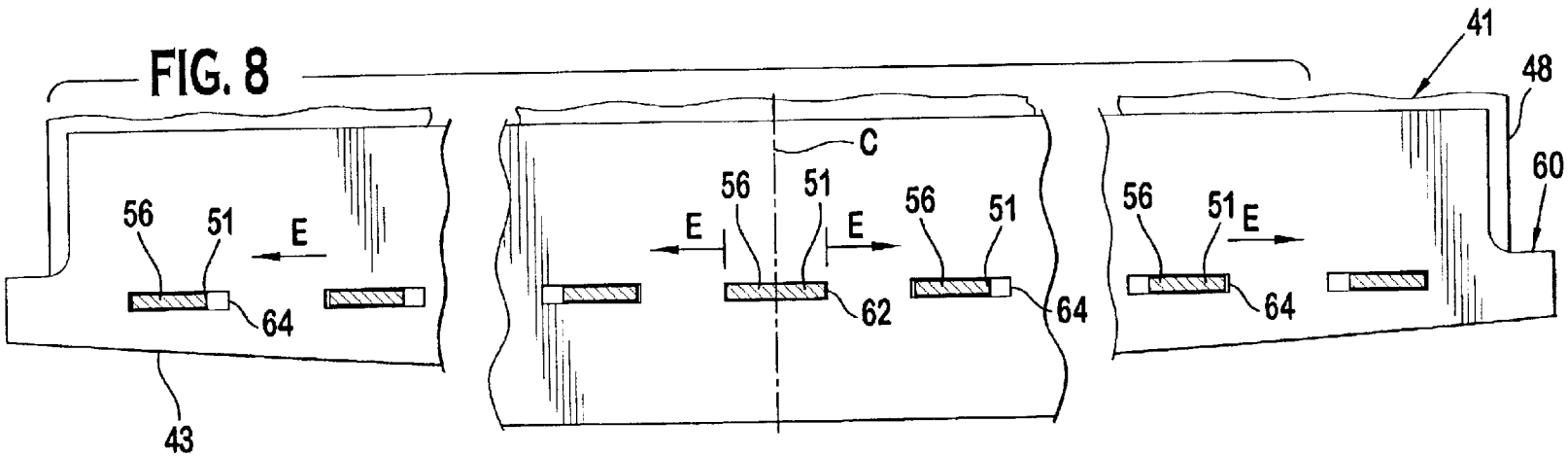
FIG. 8 is a partial cross sectional view taken along the line 7—7 of FIG. 4 showing the relative position between the insert and support blade structure during thermal cycling.

During thermal cycling, because the first and second halves 41, 45 are formed of a relatively high coefficient of thermal expansion material and the insert member 60 is formed of a relatively low coefficient of thermal expansion material, the first half 41 and front side wall 48 will expand more rapidly than the insert member during heating. As shown in FIG. 8, during expansion, the relative movement between the insert member 60 and the first half front side wall 48 is controlled about the center line C. Expansion of the front side wall 48 occurs in the directions indicated by the arrows E in FIG. 8. The central tab receiving opening 62 keeps its respective insert-securing tab 51 centrally positioned while allowing the remaining insert-securing tabs 51 to move outward in the direction E, or along the longitudinal length of the insert member 60, within the outer tab receiving openings 64. It should be noted in FIG. 8 that expansion will occur such that the insert securing tabs closest to the center will move within their respective outer tab receiving openings a smaller distance than those located further towards the outer edges of the insert member 60. The outer tab receiving openings closest to the center line C therefore have a greater clearance on their outer edges while the outer tab receiving openings 64 closest to the outer edges of the insert member 60 have a greater clearance on their inner edges.

Figure 9:
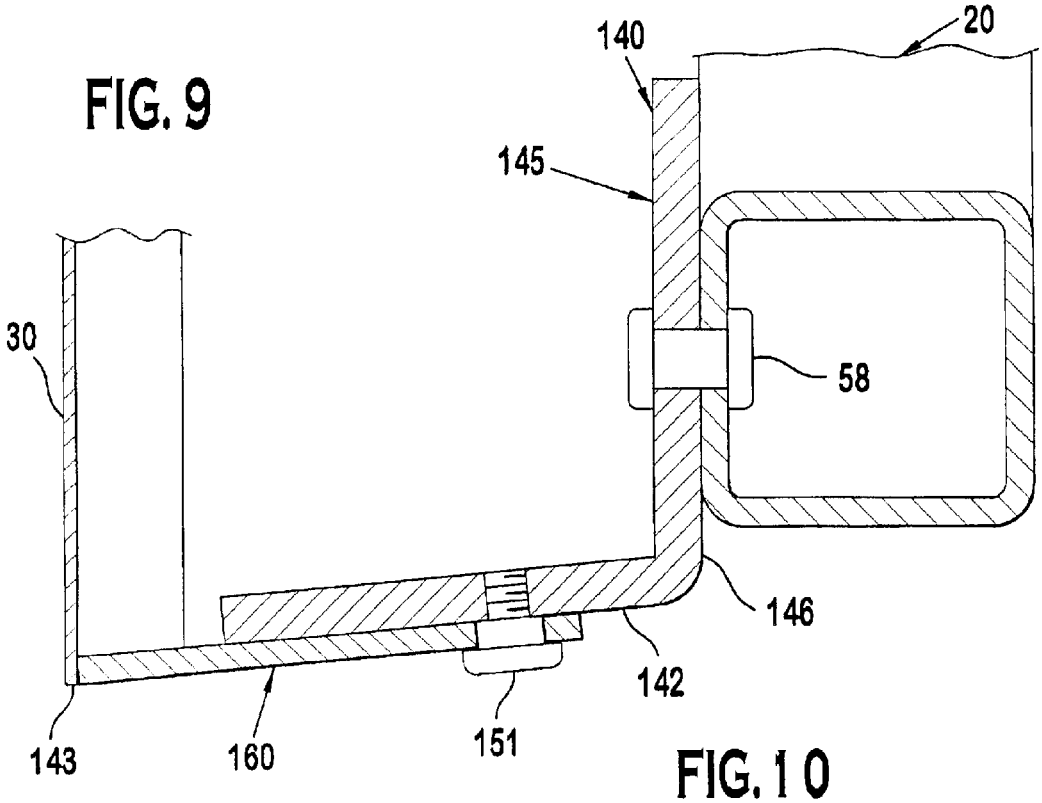
FIG. 9 is a cross sectional view similar to that of FIG. 4 for an alternate embodiment of the support blade structure.
Figure 10:
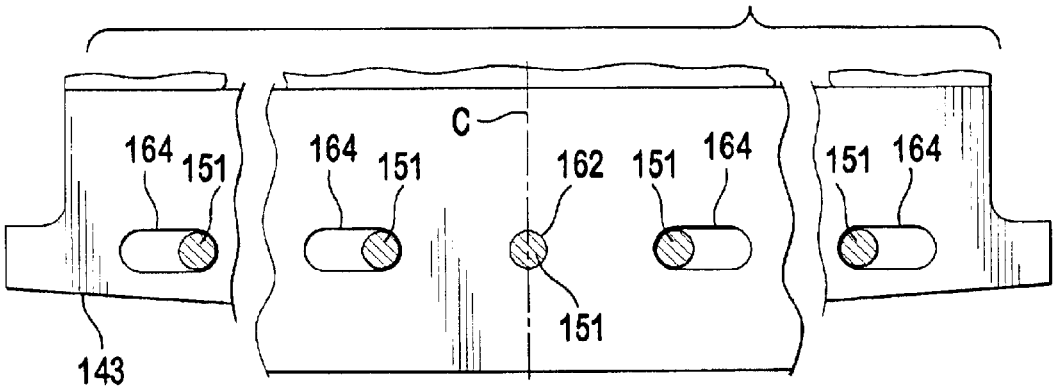
FIG. 10 is a partial cross sectional views similar to FIG. 7 showing the relative position in the alternate embodiment insert and support blade structure before thermal cycling.
Figure 11:
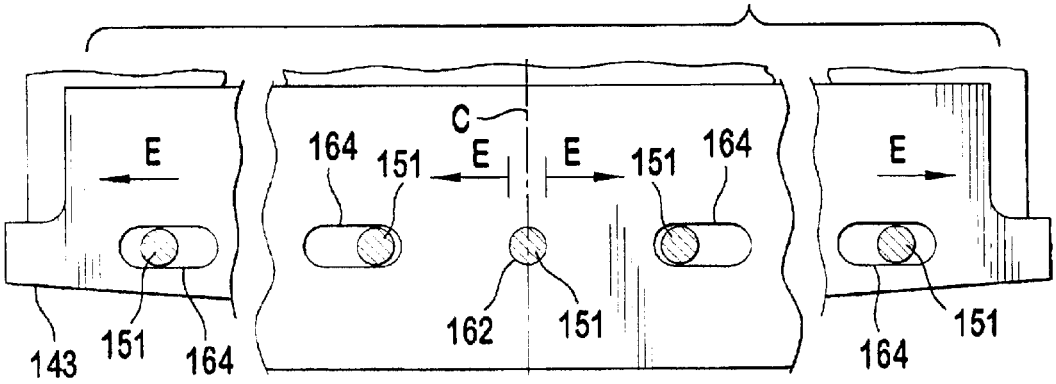
FIG. 11 is a partial cross sectional view similar to FIG. 8 showing the relative position in the alternative embodiment insert and support blade structure during thermal cycling.

An alternate embodiment of the invention is shown in FIGS. 9–11. The cross sectional view of FIG. 9 shows the tension mask 30 similarly fixed to a contoured mask receiving edge 143 of the alternate insert member 160. The alternate support blade structure 140 is different in that it does not form a closed tubular structure, but instead consists only of a single support member 145 thus eliminating the need for a second half to close the tubular structure. The single support member is similarly fastened to the frame 20. A top wall 142 extends from the rear side wall 146 to receive the insert member 160. Here, however, the insert member 160 is fixed to an outer surface of the top wall 142. The mask 30 also may function as holding or compressing the insert member 160 against the top wall 142 while in tension. It should be understood, however, that in this embodiment, the insert member 160 could alternately be fixed to the inner surface of the top wall 142 provided the fastening portion secures the insert member 160 to the top wall 142 so as to maintain adequate support for the mask 30. As shown in the present embodiment, fastening portions such as a fasteners 151 pass through fastener receiving openings 162,164 in the insert member 160. The central fastener receiving opening 162 and the outer fastener receiving openings 164 are urged differently from the embodiment of FIGS. 1–8 in order to receive the fastener 151. It should be understood that while the central fastener receiving opening 162 is preferably shown here to be circular and the outer fastener receiving openings 164 are preferably shown here to be oval, these openings may be formed in other shapes to receive different shaped fasteners. As best shown in FIG. 10, this alternate embodiment is similar to that of FIGS. 1–8 in that the central fastener receiving opening 162 is dimensioned to form a tight fit with the fastener 151 received therein while the outer fastener receiving openings 164 dimensioned to loosely receive the fasteners 151 and allow for them to move within the outer fastener receiving openings 164 during thermal expansion. Consequently, it should be understood that the insert member 160 may be connected to the support member by any suitable central fastening portion such as, for example, by welding. FIG. 11 shows the relative motion between the fasteners 151 and outer fastener receiving openings 164 during a heating cycle. Since the relative motion between these components is similar to that described with reference to FIG. 8, it will not be repeated here. It should be noted that the insert member in both embodiments is preferably selected to have a coefficient thermal expansion which is closely matched with that of the mask 30. This allows both components to expand and contract together during thermal cycling to better control the positional accuracy of the mask during processing.

An advantage of the present invention is that a relatively high coefficient of thermal expansion inexpensive material may be utilized to create support blade structure 40, 140 while a small amount of relatively expensive low coefficient of thermal expansion material may be utilized for an insert member 60. The structure of the invention allows for relative motion between the insert member 60, 160 and support blade structure 40, 140 in a controlled manner about a center to insure that the tension mask 30 remains precisely positioned behind the faceplate panel 3 during thermal cycling which occurs into processing.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A picture tube having a mask frame assembly for securing a tension mask inside said picture tube, the mask assembly comprising:

a support blade structure formed of a material having a first coefficient of thermal expansion;

an insert member formed of a material having a second coefficient of thermal expansion and a thickness which is greater than a thickness of the tension mask, the insert member having a plurality of apertures positioned along the length of the insert member and a mask receiving edge to which said tension mask is applied; and, fastening portions, at least one fastening portion connecting said insert member to said support blade structure at a generally central location of the insert member and said remaining fastening portions connecting said insert member to said support structure through said apertures whereby the opening of said apertures are dimensioned to have a respective clearance for loosely receiving a respective fastening portion.

2. The picture tube of claim 1 wherein the openings of said apertures are dimensioned to permit the fastening portions to slide within the apertures along the length of the insert member permitting the insert member to move relative to the support blade structure.

3. The picture tube of claim 1 wherein the fastening portions comprise fasteners passing through the apertures of the insert member.

4. The picture tube of claim 1 wherein the support structure further comprises first and second interlocking halves.

5. The picture tube of claim 4 wherein the fastening portions comprise tabs located along an edge of the first half.

6. The picture tube of claim 5 wherein each tab comprises a narrow portion and a wide portion.

7. The picture tube of claim 6 wherein the narrow and wide portions are separated by a stop surface.

8. The picture tube of claim 7 wherein the stop surface abuts a surface of the second half.

9. A picture tube having a support blade structure for a tension mask frame assembly, the support blade structure comprising:

an insert member connected to the support blade structure at a generally central location of the insert member, the insert member being formed of a material having a thickness which is greater than a thickness of said tension mask and further comprising a plurality of apertures extending from the central location along its length and a mask receiving edge to which said tension mask is applied; and, fastening portions extending through at least one of said apertures to connect the insert member to the support blade structure wherein the apertures are dimensioned to be larger than the fastening portions to permit movement of the support structure relative to the insert member along the length of the insert member.

10. The picture tube of claim 9, wherein the insert member and the support structure are formed of a material being of different coefficient of thermal expansion.

* * * * *